United States Patent [19]

Mayer et al.

[11] Patent Number: 4,557,226

[45] Date of Patent: Dec. 10, 1985

[54] DEVICE FOR RETURNING THE BLOW-BY RATE FROM THE CRANKCASE INTO THE SYSTEM OF A SUPERCHARGED INTERNAL COMBUSTION ENGINE

[75] Inventors: Andreas Mayer, Niederrohrdorf, Switzerland; Rudolf Stüssi, Los Angeles, Calif.

[73] Assignee: BBC Brown, Boveri & Company, Limited, Baden, Switzerland

[21] Appl. No.: 670,575

[22] Filed: Nov. 13, 1984

[51] Int. Cl.[4] ..... F01M 13/00

[52] U.S. Cl. ..... 123/41.86; 123/572

[58] Field of Search ..... 123/41.86, 572–574, 123/559

[56] References Cited

U.S. PATENT DOCUMENTS

| | | | |
|---|---|---|---|
| 3,246,639 | 4/1966 | Oliner | 123/572 |
| 3,456,759 | 7/1969 | Henry-Biabaud | 123/41.86 |
| 3,616,779 | 11/1971 | Newkirk | 123/41.86 |
| 3,754,538 | 8/1973 | Ephraim, Jr. et al. | 123/41.86 |
| 3,990,421 | 11/1976 | Grainger | 123/572 |
| 4,488,532 | 12/1984 | Mayer | 123/559 |

*Primary Examiner*—William A. Cuchlinski, Jr.
*Attorney, Agent, or Firm*—Oblon, Fisher, Spivak, McClelland & Maier

[57] ABSTRACT

In internal combustion engines (1), the sealing of the combustion chamber by pistons and piston rings is not absolute. Throughout the working cycle, gases from the cylinder enter the crankcase (1*a*). These blow-by gases must be able to escape from the crankcase (1*a*). In a device for returning the blow-by gases into the system of an internal combustion engine (1) supercharged with a gas-dynamic pressure-wave supercharger (10), it is envisaged that a gas delivery unit designed as an ejector (20) generates a reduced pressure in the crankcase (1*a*). The ejector (20) is operated with a propellant gas from a line (16) which is taken from the supercharger airline (13), a control (8) placed in the propellant gas line (16) ensuring that the reduced pressure in the crankcase (1*a*) never exceeds a defined value. The blow-by gases in the line (2) flow through an oil separator (4) and, mixed with the propellant gas in the line (16), are then returned into the exhaust line (15) of the engine system.

12 Claims, 5 Drawing Figures

DEVICE FOR RETURNING THE BLOW-BY RATE FROM THE CRANKCASE INTO THE SYSTEM OF A SUPERCHARGED INTERNAL COMBUSTION ENGINE

FIELD OF THE INVENTION

The present invention relates to a device for returning the blow-by gases from the crankcase having a gas delivery unit which is driven by a propellant and which, when a control device placed in the extraction line is connected in, generates a reduced pressure in the crankcase.

BACKGROUND OF THE INVENTION

In internal combustion engines, the sealing of the combustion chamber by the pistons and piston rings is not absolute. Throughout the working cycle, gases pass from the cylinder into the crankcase. These gases—below called blow-by gases or BB gases for short—must be able to escape from the crankcase. This is usually effected by providing an orifice on the valve cover or engine block.

Protection of the environment demands prevention of an escape of oil from the engine. In naturally aspirated engines, the oil mist blown out of the crankcase (BB gases) is passed back into the induction side of the engine, so that external oil contamination is avoided. In fact, this measure has become a statutory regulation for gasoline engines in many countries. Corresponding proposals have the aim of introducing this technique also in the diesel engine.

In some countries, regulations provide that, in spark-ignition engines, a reduced pressure must prevail in the crankcase throughout the load and speed range, in order to avoid an escape of oil through the seals of the crankcase. In principle, only a slightly reduced pressure should prevail in the crankcase throughout the operating range, since, the greater the reduced pressure, the more oil is disadvantageously extracted together with the BB gas.

It is then customary to return the BB gases into the induction line of the internal combustion engine upstream of the air filter or to pass them into the open through an oil separator. In the case of a return of the BB gases into the induction line, some motor manufacturers see an advantage in valve lubrication, but others do not utilise the BB return for this purpose.

The oil separator can be integrated in the valve cover or it can be inserted as an individual component. It filters out a large proportion of the oil contained in the BB gas before the BB gas passes into the open or is returned into the engine—that is to say, fed to combustion.

When the oil separators nowadays available on the market are used, however, a considerable quantity of oil still breaks through. The requirement of establishing a reduced pressure in the crankcase hitherto did not permit the use of oil separators having a higher degree of purification of the BB gas. In fact, higher oil separation causes a greater pressure drop in the filter, so that the desired reduced pressure in the crankcase is no longer ensured.

For an internal combustion engine supercharged by a turbo-charger, printed publication GB-A 2 006 329 has disclosed the extraction of the BB gases from the crankcase with the aid of a pump system designed as an ejector or jet pump. The propellant used here is preferably supercharging air. The BB gases to be extracted from the crankcase flow through a control device which is placed in the extraction line and which controls the reduced pressure desired in the crankcase. The extracted BB gases are then returned into the system of the internal combustion engine. Such a circuit has the aim of obtaining vigorous extraction by means closely connected with the engine.

However, this presupposes that the propellants employed possess sufficient stored energy. Under full load, this is generally the case, but it is not the case when the engine runs under part load. In such cases, the supercharging pressure can hardly maintain the extraction of the BB gases from the crankcase, even if the control device is by-passed.

If, furthermore, an oil separator were to be provided downstream of a pump system, it would no longer be possible to establish the desired reduced pressure in the crankcase.

OBJECT OF THE INVENTION

It is this point where the invention is to provide a remedy. The invention the object of generating a controlled, limited reduced pressure in the crankcase throughout the operation range in such a way that the BB gases can be sufficiently cleaned in an appropriately designed oil separator placed upstream of the gas delivery unit, before the BB gases are returned into the system of the internal combustion engine.

SUMMARY OF THE INVENTION

In the internal combustion engine supercharged with a gas-dynamic pressure-wave supercharger, the foregoing object is achieved by running the gas delivery unit with a propellant gas which is branched off on the air side upstream of the starter valve flap placed downstream of the gas-dynamic pressure-wave supercharger.

ADVANTAGES OF THE INVENTION

It is to be regarded as the essential advantage of the invention that, at low-pressure states in the internal combustion engine, the starter valve flap is closed, so that the propellant gas, branched off on the air side upstream thereof, contains sufficient energy from the compression by the gas-dynamic pressure-wave supercharger. It is thus ensured that the gas delivery unit, which preferably is an ejector, is operated throughout the operating range with a sufficiently large propellant gas energy for fulfilling its intended task—namely, to generate, via the oil separator, a reduced pressure in the crankcase. A control which is placed in the propellant gas line and through which a clean medium always flows, fulfils the task, generally and in particular under full load, of maintaining the reduced pressure in the crankcase at a predetermined value, so that losses with respect to the supercharging pressure and the temperature of the supercharging air can be minimised.

GENERAL DISCUSSION OF THE INVENTION

Propellant gas rate control and pressure-modulation control are preferred embodiments of the invention with respect to the type of control.

In a further preferred embodiment of the invention, the gas delivery unit is a venturi diffusor which is placed in the exhaust line. The venturi nozzle can then be supplemented by an ejector partly fed by the slipstream, so that the suction effect of the venturi diffusor is reinforced during motion.

In a further preferred embodiment of the invention, the cleaned BB gases from the crankcase are returned into the low-pressure exhaust line of the system of the internal combustion engine. The advantage is that the temperatures at this point are so low that cracking processes can hardly take place there. Due to the presence of an oil separator with a very high separation efficiency, it can be assumed that virtually oil-free waste gases leave the exhaust system.

Moreover, the BB gases from the crankcase—in a further preferred embodiment—are utilised for valve lubrication when the internal combustion engine is idling. A non-return valve provided here prevents a flow of supercharging air into the line of the BB gases when the internal combustion engine picks up load.

BRIEF DESCRIPTION OF THE DRAWINGS

Illustrative embodiments of the invention are diagrammatically shown in the drawing in which.

All the elements not necessary for direct understanding of the invention have been omitted. The direction of flow of the working media is marked with arrows. In the various figures, identical elements are provided with identical reference numerals.

DETAILED DESCRIPTION OF THE PRESENTLY PREFERRED EMBODIMENTS

Figure 1:
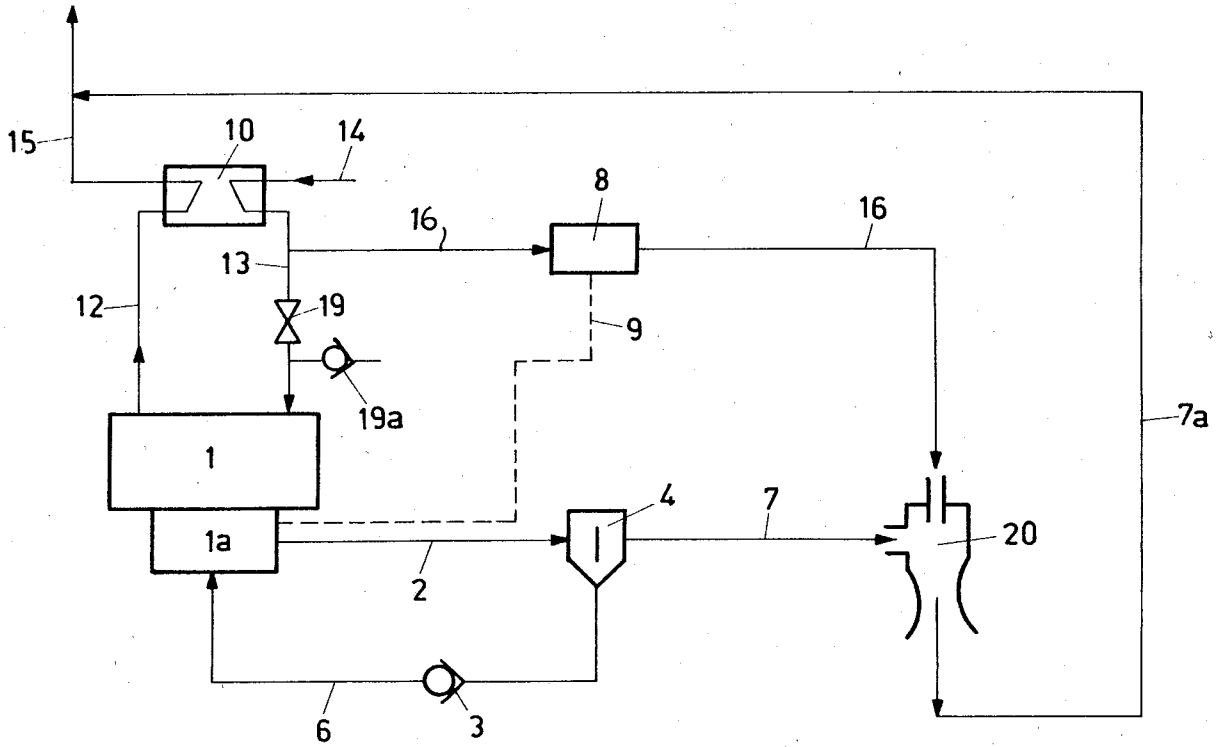
FIG. 1 shows a diagram of a device for cleaning and returning the BB gases into the system of an internal combustion engine supercharged with a gas-dynamic pressure-wave supercharger.

According to FIG. 1, the internal combustion engine 1 is connected on the air side via a supercharging airline 13 to a gas-dynamic pressure-wave supercharger 10. The latter is provided on the low-pressure side with an induction line 14 for fresh air. The mode of operation of the gas-dynamic pressure-wave supercharger 10 is explained in Swiss Patent Specification No. 418 730. The engine exhaust gases pass into the pressure-wave supercharger 10, via a line 12. From the pressure-wave supercharger 10, the engine exhaust gases are expelled, after they have given up their energy, via an exhaust line 15 into the atmosphere. A starter valve flap 19 is placed in the supercharging airline 13. A propellant gas line 16 branches off between the pressure-wave supercharger 10 and the starter valve flap 19. The propellant gas taken in this line from the supercharging airline 13 is passed to a gas delivery unit, which is an ejector 20 in the present example. The ejector 20 ensures that a reduced pressure is generated in the crankcase 1*a*. The BB gases flowing out of the crankcase 1*a* via a line 2 pass through an oil separator 4 and then, as cleaned BB gases, reach the exhaust line 15 via the line 7, the ejector 20, and a BB gas/propellant gas mixture line 7*a*. The oil separated out in the oil separator 4 is returned into the engine system 1, 1*a* via the oil return 6, whereby the oil loss can be substantially reduced. The safety valve 3 placed in the oil return 6 ensures that oil from the internal combustion engine 1 or the crankcase 1*a* cannot flow back into the oil separator 4. In low-pressure states, in particular under part load in the internal combustion engine 1, the starter valve flap 19 is closed, so that, in the supercharging airline 13 upstream of the latter, the pressure level can rapidly build up by means of the working pressure-wave supercharger 10. The propellant gas in the propellant gas line 16 tapped off the supercharging air line 13 has sufficient energy for ensuring the necessary suction effect in the ejector 20, even during part load phases of the internal combustion engine 1. During these phases, the fresh air supply for the internal combustion engine 1 is maintained through the starter valve by-pass 19*a*.

The controller 8 in the propellant gas line 16 has the task, by means of the controller signal 9, of preventing the magnitude of the reduced pressure in the crankcase 1*a* from rising above a defined value, since a great risk in this arrangement is precisely that—in particular under full load—excessive quantities of oil are removed from the internal combustion engine 1.

Figure 2:
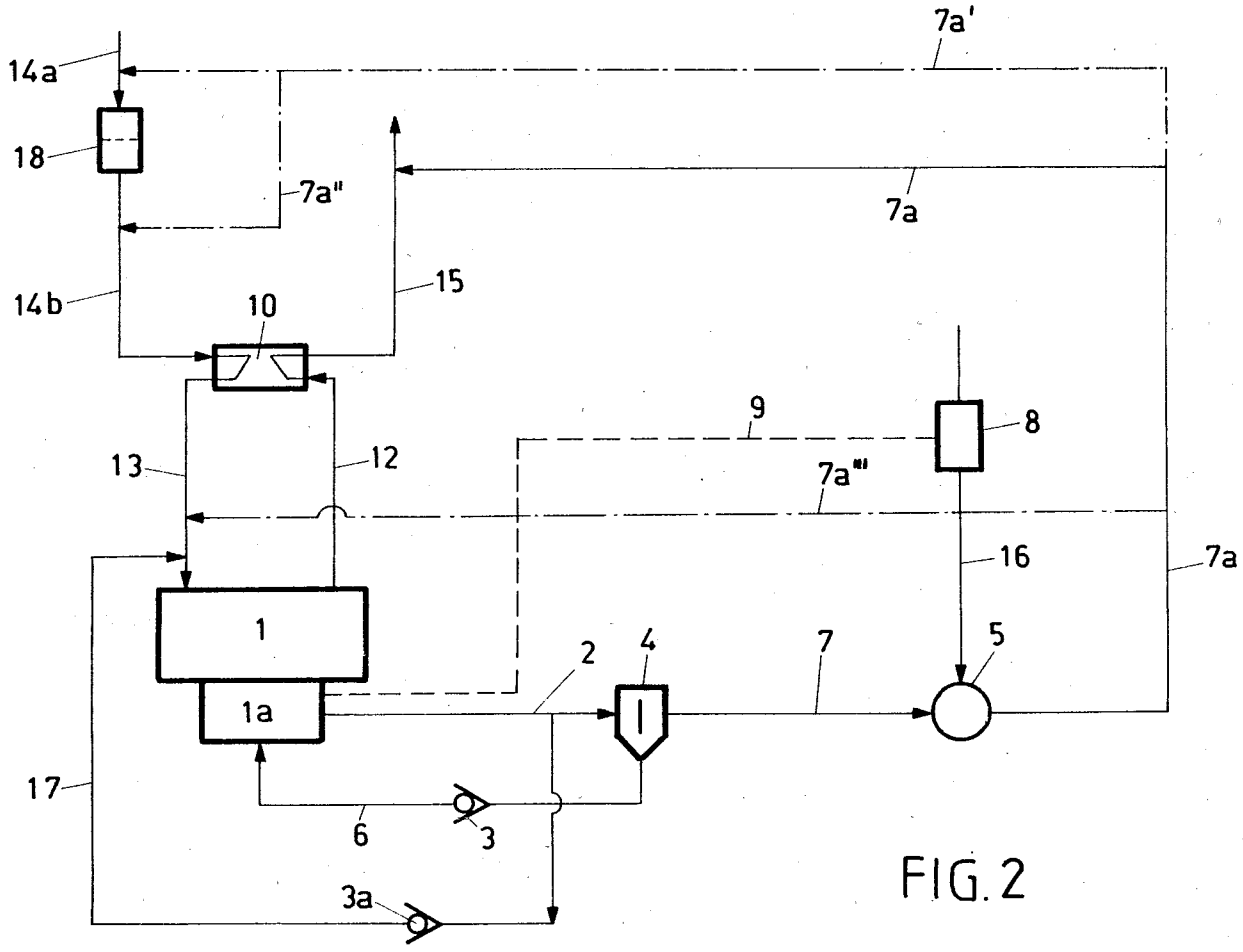
FIG. 2 shows a further diagram with various points to which the BB gases are returned.

FIG. 2 is a further embodiment of the arrangement described with reference to FIG. 1. Here, in FIG. 2, the point is only to indicate the possible arrangements for the induction of fresh air and for the return of the cleaned BB gases in the line 7 into the system of the internal combustion engine 1. Moreover, the ejector 20 in the FIG. 1 embodiment has been replaced by a pump 5, which also serves as a gas delivery unit. An induction air line 14*a*, 14*b* introduced air through an air filter 18, before the air is compressed by the engine exhaust gases introduced into the pressure-wave supercharger 10 via the line 12 to provide supercharging air in the line 13 for the internal combustion engine 1. The cleaned BB gases in line 7 and the propellant gas in the line 16 are—as already shown by FIG. 1—returned as a gas mixture in the line 7*a* into the exhaust line 15. Depending on the layout of the arrangement, the gas mixture in the line 7*a* can also be returned into the induction airline 14*a* upstream of the filter 18 by means of the line 7*a*′, or into the induction airline 14*b* downstream of the filter 18 by means of the line 7*a*″, or into the supercharging airline 13 by means of the line 7*a*‴.

When the internal combustion engine 1 is idling, the BB gases in the line 2 can be used for valve lubrication in the line 17. A non-return valve 3*a* prevents a flow of supercharging air from the line 13 into the BB gas line 2 when the internal combustion engine picks up load.

Figure 3:
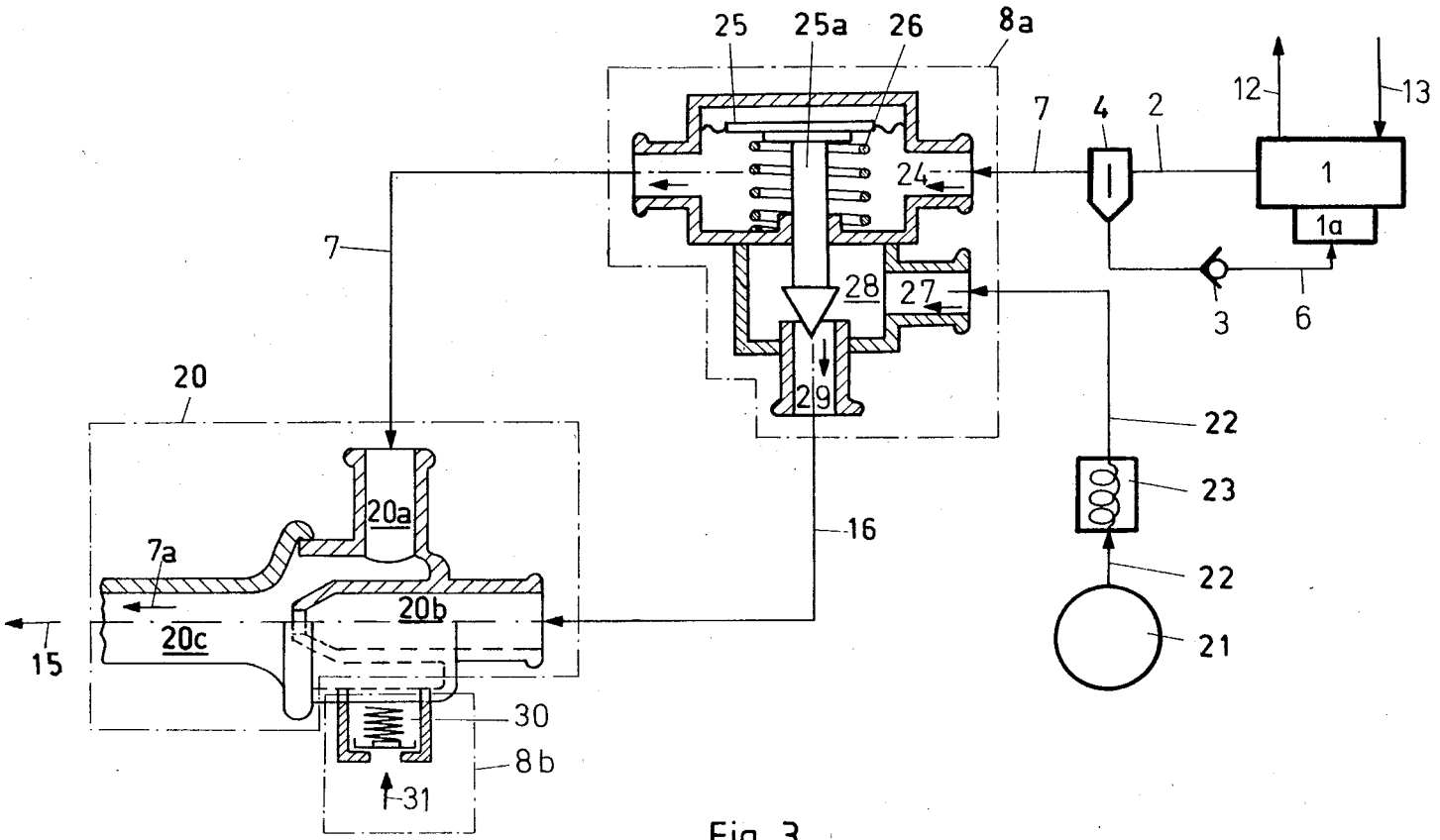
FIG. 3 shows a possible way of delivering the BB gases, with propellant gas rate control, pressure-modulation control and ejector.

FIG. 3 shows the use of the ejector 20, with the associated control. It is to be noted here that the propellant gas rate control 8*a* described here is not restricted to a supply of propellant gas from the supercharging airline 13 of the gas-dynamic pressure-wave supercharger 10 (see FIG. 1). According to FIG. 3, the working gas in the line 22 used as the propellant gas is taken from a pressure accumulator 21. Engine exhaust gas as the working gas in the line 22 can be cooled and cleaned in an assembly 23, in order to prevent fouling and coking of the BB oil. Of course, the propellant gas can also be taken from the pockets of a gas-dynamic pressure-wave supercharger. As already stated above, the propellant gas rate control 8*a* has the task of restricting the working gas in the line 22 or the propellant gas rate to the required minimum.

The cleaned BB gases in the line 7 flow through the diaphragm chamber 24 and then enter the suction branch 20*a* of the ejector 20. The crankcase pressure thus prevails in the diaphragm chamber 24. The position of the diaphragm 25 sets itself via the pressure difference between the two sides of the diaphragm, the spring 26 automatically controlling the degree of throttling which the working gas in the line 22 undergoes in the propellant gas rate control 8*a*. The working gas in the line 22 enters the propellant gas rate control 8*a* through the inflow orifice 27, completely fills the expansion chamber 28 and then flows out again as the propellant gas in the line 16 from the controlled exit orifice 29. The less the working gas in the line 22 is throttled, the higher the pressure of the modified working gas—now called propellant gas in conformity with the preceding description—and the greater the propellant gas rate flowing through the propellant branch 20*b*. This in turn has the effect of increasing the suction effect of the ejector 20. When the suction effect of the ejector 20 is increased, the reduced pressure in the crankcase 1*a* is intensified, and it is held at a predetermined value by the propellant gas rate control 8*a*. The gas mixture 7*a* flows through the pressure branch 20*c* of the ejector 20 and is then returned into the exhaust line 15.

The needle 25*a* actuated by the diaphragm 25 can also dip directly into the propellant branch 20*b* and, by its position, vary the inlet area of the propellant branch or the outlet area of the propellant nozzle, these areas determining the throughput of propellant gas. The reduced pressure in the crankcase 1*a* can also be limited by a pressure-modulation control 8*b*. When the reduced pressure predefined in the propellant branch 20*b* becomes excessive, the snifter valve 30 opens and air 31 flows in, thus establishing equilibrium.

Figure 4:
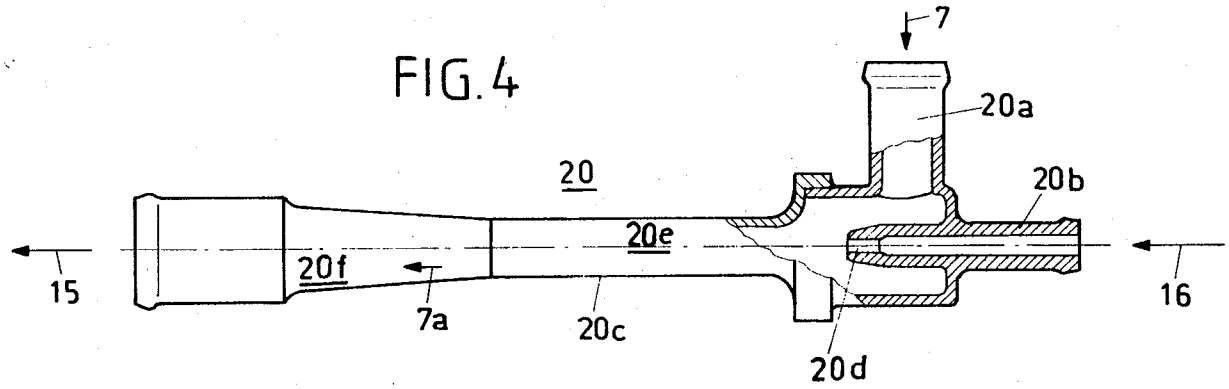
FIG. 4 shows an ejector as the gas delivery unit.

The ejector 20 shown in FIG. 4 may be made of plastic. It essentially consists of a suction branch 20*a*, propellant branch 20*b*, pressure branch 20*c*, propellant nozzle 20*d*, mixing tube 20*e* and diffusor 20*f*. The propellant gas 16 passes via the propellant branch 20*b* into the ejector 20 and is accelerated in the propellant nozzle 20*d*. The cleaned BB gases in the line 7 flow into the suction branch 20*a*. In the mixing tube 20*e*, the propellant gases from the line 16 and BB gases from the line 7 come into mutual contact, the BB gases 7 from the line being accelerated by an exchange of momentum. The diffusor 20*f* has the task of converting the velocity energy of the gas mixture 7*a* into pressure energy.

The ejector 20, the dimensions of which, at a total length of about 200 mm and an overall height of about 50 mm, make installation very easy, can be mounted at any desired point. It can be freely suspended in hoses, or it can be fixed by means of clamps or clips to the engine. The position can thus be determined under the aspects of short lines, in order to reduce the costs and pressure drops, and good accessibility. The line carrying the propellant gas should have an internal diameter which is nowhere less than the minimum of 7 mm, and should withstand a supercharging pressure of 2 bar and a propellant gas temperature of 160° C. maximum. The remaining connections of the ejector 20 do not have to meet any demands going beyond the usual motor vehicle standard.

Figure 5:
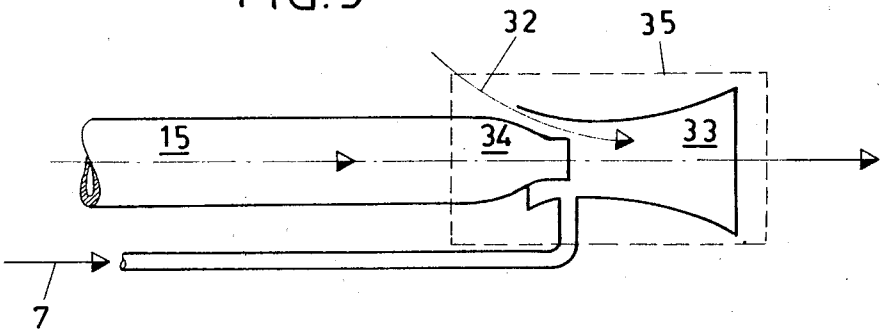
FIG. 5 shows a venturi nozzle as the gas delivery unit.

As the pump, FIG. 5 shows a venturi nozzle 34 with a diffusor 33, which are placed in the exhaust line 15. The energy of the low-pressure gas is used for generating a reduced pressure in the exhaust line 15 and for venting the cleaned BB gases in the line 7 into the latter. The criterion for the use of such devices is the exhaust gas back-pressure which must be overcome. Immediately downstream of the gas-dynamic pressure-wave supercharger (FIG. 1, item 10) this back pressure is about 600–800 mm water gauge, depending on the flow velocity. The pressure drop in the oil separator (FIG. 1, item 4), which in this case should have a particularly high separation efficiency, must also be added to this. The venturi nozzle 34 is therefore advantageously installed immediately upstream of the end of the exhaust pipe, that is to say where the exhaust back-pressure is virtually equal to atmospheric pressure. In an adjoining diffusor 33, the exit velocity is reduced or pressure is recovered.

The venturi diffusor 35 can be structurally designed in such a way that, at high vehicle speeds, the slipstream 32 is also utilised for generating a reduced pressure in the venturi nozzle 34. Accordingly, an additional ejector effect is obtained with the slipstream 32 as the propellant gas. As a result, the low-pressure flushing of the gas-dynamic pressure-wave supercharger (FIG. 1, item 10) is additionally improved.

In addition, the diffusor 33 can be fitted with a baffle (not shown) for pressure recovery.

We claim:

1. Device for returning the blow-by gases from the crankcase into the system of a supercharged internal combustion engine, having a gas delivery unit which is driven by a propellant and which, when a control device placed in the extraction line is connected in, generates a reduced pressure in the crankcase, wherein the internal combustion engine is supercharged by a gas-dynamic pressure-wave supercharger and the propellant for the gas delivery unit is gas which is taken from the output of the gas-dynamic pressure-wave supercharger in a propellant line and which is controllable by means of a controller placed in the propellant line in such a way that, throughout the operating range, a reduced pressure of not greater than −50 mbar prevails in the crankcase.

2. Device according to claim 1 wherein the propellant line branches off on the air side downstream of the gas-dynamic pressure-wave supercharger and upstream of a starter valve flap.

3. Device according to claim 1 wherein the propellant line is connected to one of the pockets of the gas-dynamic pressure-wave supercharger.

4. Device according to claim 1 wherein the gas delivery unit is an ejector.

5. Device according to claim 4 wherein the ejector is made of plastic.

6. Device according to claim 4 wherein the ejector is connected to the internal combustion engine system by hoses.

7. Device according to claim 1 wherein the oil separator is provided upstream of the gas delivery unit.

8. Device according to claim 1 wherein the degree of reduced pressure in the crankcase is controlled by means of a propellant gas rate control.

9. Device according to claim 1 wherein the degree of reduced pressure in the crankcase is controlled by means of a pressure-modulation control.

10. Device according to claim 1 wherein an exhaust line is operatively connected to the engine and the gas delivery unit is a venturi nozzle placed in the exhaust line.

11. Device according to claim 1 wherein the cleaned gases from the crankcase are returnable to a point in the gas-dynamic pressure-wave supercharger where a reduced pressure prevails.

12. Device according to claim 1 wherein, when the internal combustion engine is idling, valve lubrication is effected by the blow-by gases from the crankcase, a non-return valve preventing a flow of supercharging air into the line of the blow-by gases when the internal combustion engine picks up load.

* * * * *

UNITED STATES PATENT AND TRADEMARK OFFICE

CERTIFICATE OF CORRECTION

PATENT NO. : 4,557,226

DATED : December 10, 1985

INVENTOR(S) : Andreas Mayer, et al

It is certified that error appears in the above-identified patent and that said Letters Patent is hereby corrected as shown below:

-- The priority information on this Letters Patent has been omitted. Please add the following priority number:

6106/83-6 Switzerland 14.11.83--

Signed and Sealed this

*Eighteenth* Day of *February 1986*

[SEAL]

*Attest:*

DONALD J. QUIGG

*Attesting Officer* *Commissioner of Patents and Trademarks*